United States Patent [19]

Homberger et al.

[11] Patent Number: 4,874,578

[45] Date of Patent: Oct. 17, 1989

[54] ALUMINIUM ALLOY FOR SUPERPLASTIC FORMING

[75] Inventors: Heinrich Homberger, Beringen, Switzerland; Jürgen Timm, Steisslingen, Fed. Rep. of Germany; Pedro Rodriques, Lisboa, Portugal

[73] Assignee: Swiss Aluminium Ltd., Chippis, Switzerland

[21] Appl. No.: 209,081

[22] Filed: Jun. 20, 1988

[30] Foreign Application Priority Data

Jun. 23, 1987 [CH] Switzerland ..... 2359/87

[51] Int. Cl.[4] ..... C22C 21/00

[52] U.S. Cl. ..... 420/541; 148/11.5 A; 420/543; 420/902

[58] Field of Search ..... 420/542, 543–547, 420/541, 902; 148/2, 11.5 A

[56] References Cited

U.S. PATENT DOCUMENTS 4,021,271 5/1977 Roberts ..... 148/2
4,033,794 7/1977 Stowell et al. ..... 420/548

FOREIGN PATENT DOCUMENTS 2242235 3/1973 Fed. Rep. of Germany .
2214755 8/1974 France .

OTHER PUBLICATIONS

Journal of Materials Science, Band 22, No. 1, 1987, Chapman and Hall, Ltd.

*Primary Examiner*—R. Dean
*Attorney, Agent, or Firm*—Bachman & LaPointe

[57] ABSTRACT

An aluminium alloy suitable as a material for superplastic forming contains
0.8–2.5% or iron,
3.5–6.0% of magnesium,
0.1–0.6% of manganese,
0.05–0.5% of zirconium,
at most 6.0% of zinc,
at most 3.0% of copper,
at most 0.3% of silicon,
at most 0.05% of titanium and
at most 0.05% of chromium, the remainder being aluminium of commercial purity.

The alloy can be processed to give superplastically formable sheets without separate thermomechanical pretreatment.

12 Claims, No Drawings

ALUMINIUM ALLOY FOR SUPERPLASTIC FORMING

BACKGROUND OF THE INVENTION

The invention relates to an aluminum alloy as a material for superplastic forming.

Superplastically formable materials have been known for a long time. The most important prior requirement is here the fine-grained structure of the material to be formed. Thus, for example, in the case of sheets which are to be formed superplastically, a grain size of preferably less than 10 μm is required. In addition, the grains should be in an almost globulitic form. Moreover, no substantial enlargement of the grains must take place during superplastic forming, which is carried out at about 500° C. With the known alloys suitable for superplastic forming, these requirements in general make an expensive thermomechanical pretreatment necessary.

SUMMARY OF THE INVENTION

In the light of these conditions, it was the object of the inventor to provide an aluminium alloy which is suitable as a material for superplastic forming and which can be processed into superplastically formable sheets without a separate thermomechanical pretreatment.

DETAILED DESCRIPTION

The foregoing object is achieved when the alloy contains 0.8–2.5% of iron,
3.5–6.0% of magnesium,
0.1–0.6% of manganese,
0.05–0.5% of zirconium,
at most 6.0% of zinc,
at most 3.0% of copper,
at most 0.3% of silicon,
at most 0.05% of titanium and
at most 0.05% of chromium,
the remainder being aluminium of commercial purity.

The maximum permissible iron content of 2.5% is provided when the alloy is processed over casting rollers or when other casting processes with sudden solidification are used. If the alloy is cast by means of conventional or electromagnetic continuous casting moulds, the maximum permissible iron content is 1.6%. If these upper limits of the iron content are adhered to, undesired presolidifications can be prevented. Generally, however, it is to be noted that the addition of manganese should be kept rather low if the iron content is high.

For the individual elements, the following content ranges have proved to be preferred:

1.0–1.4% of iron,
4.0–5.0% of magnesium,
0.1–0.3% of manganese,
0.1–0.2% of zirconium and
at most 0.15% of silicon.

An addition of zinc and/or copper serves for a general increase in strength of the alloy. The zinc addition is here preferably between 3.0 and 4.0%.

An alloy which is especially suitable as a material for superplastic forming has the following composition:

1.1–1.3% of iron,
4.3–4.7% of magnesium,
0.1–0.3% of manganese, 0.1–0.2% of zirconium,
at most 0.15% of silicon,
at most 0.05% of titanium and
at most 0.05% of chromium,
the remainder being aluminium of commercial purity.

All the content data concerning the alloy composition relate to percent by weight.

The alloy according to the invention is preferably cast by means of conventional or electromagnetic continuous casting moulds to give rolling slabs and can be processed without separate thermomechanical pretreatment to give superplastically formable sheets. To ensure that the required fine-grain structure is reached, the amount of deformation on cold rolling should be at least 60% and preferably at least 70%. If inter annealing is carried out, the minimum amount of deformation relates to the cold-rolling to the final thickness after inter annealing has been carried out.

The advantageousness of the alloy according to the invention is demonstrated below by reference to an illustrative example.

EXAMPLE

An alloy with 1.2% of iron, 4.54% of magnesium, 0.24% of manganese, 0.15% of zirconium, 0.10% of silicon and 0.03% of titanium was cast by means of a continuous casting mould to give a rolling slab of 70 mm thickness and homogenized for 24 hours at a temperature of 450° C. The slab was then heated to 500° C. and hot rolled to a thickness of 12 mm. After cooling, the hot rolled plates were cold rolled as follows:

Variant A: cold rolled to 3 mm without inter annealing;
Variant B: cold rolled to 6 mm, inter annealed for 12 hours at 400° C., cold rolled to 1.2 mm.

For testing the superplastic forming behaviour, tensile specimens of a stem width of 10 mm and a gauge length of 20 mm were made from the coldrolled sheets and deformed to fracture on a tensile tester at a temperature of 490° C. and had a true strain rate of $5\times10^{-4}s^{-1}$. The strain values reached were 550% for variant A and 585% for variant B.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

We claim:

1. An aluminum alloy having excellent superplastic forming properties, the alloy consisting essentially of:

0.8–2.5% of iron,
3.5–6.0% of magnesium,
0.1–0.6% of manganese,
0.05–0.5% of zirconium,
at most 6.0% of zinc,
at most 3.0% of copper,
at most 0.3% of silicon,
at most 0.05% of titanium,
at most 0.05% of chromium,
and
the balance being substantially aluminum of commercial purity.

2. An aluminum alloy according to claim 1 wherein the iron content is 0.8–1.6%.

3. An aluminum alloy according to claim 1 wherein the iron content is 1.0–1.4%.

4. An aluminum alloy according to claim 1 wherein the magnesium content is 4.0–5.0%.

5. An aluminum alloy according to claim 1 wherein the manganese content is 0.1–0.3%.

6. An aluminum alloy according to claim 1 wherein the zirconium content is 0.1–0.2%.

7. An aluminum alloy according to claim 1 wherein the silicon content is at most 0.15%.

8. An aluminum alloy according to claim 1 wherein the zinc content is 3.0 to 4.0%.

9. An aluminum alloy according to claim 1 wherein the alloy consists essentially of:

1.1–1.3% of iron,
4.3–4.7% of magnesium,
0.1–0.3% of manganese,
0.1–0.2% of zirconium,
at most 0.15% of silicon,
at most 0.05% of titanium,
at most 0.05% of chromium, and the balance being substantially aluminum of commercial purity.

10. A process for producing a superplastically formable sheet from an aluminum alloy comprising providing the alloy of claim 1, casting said alloy, hot rolling and cold rolling on said cast alloy, wherein the amount of deformation in cold rolling to the final thickness is at least 60%.

11. A process according to claim 10 wherein said deformation is at least 70%.

12. An aluminum alloy having excellent superplastic forming properties, the alloy consisting essentially of:

1.1–1.3% of iron,
4.3–4.7% of magnesium,
0.1–0.6% of manganese,
0.05–0.5% of zirconium,
at most 6.0% of zinc,
at most 3.0% of copper,
at most 0.3% of silicon,
at most 0.05% of titanium,
at most 0.05% of chromium, and the balance being substantially aluminum of commercial purity.

* * * * *